US006823936B2

(12) United States Patent
Wilson

(10) Patent No.: US 6,823,936 B2
(45) Date of Patent: Nov. 30, 2004

(54) FLUID FLOW CONTROL APPARATUS

(75) Inventor: James Brian Wilson, Nailsea (GB)

(73) Assignee: ABB Offshore Systems Limited, Bristol (GB)

( * ) Notice: Subject to any disclaimer, the term of this patent is extended or adjusted under 35 U.S.C. 154(b) by 0 days.

(21) Appl. No.: 10/240,471

(22) PCT Filed: Feb. 15, 2002

(86) PCT No.: PCT/GB02/00691

§ 371 (c)(1),
(2), (4) Date: Oct. 2, 2002

(87) PCT Pub. No.: WO02/066788

PCT Pub. Date: Aug. 29, 2002

(65) Prior Publication Data

US 2003/0145993 A1 Aug. 7, 2003

(30) Foreign Application Priority Data

Feb. 21, 2001 (GB) ..... 0104269

(51) Int. Cl.[7] ..... E21B 43/14; E21B 34/06

(52) U.S. Cl. ..... 166/50; 166/320; 166/313; 166/386

(58) Field of Search ..... 166/50, 313, 320, 166/386

(56) References Cited

U.S. PATENT DOCUMENTS

| | | | | | |
|---|---|---|---|---|---|
| 2,798,561 | A | * | 7/1957 | True | 166/321 |
| 2,963,089 | A | | 9/1960 | Sizer | |
| 2,951,536 | A | | 12/1960 | Garrett | |
| 5,141,057 | A | | 8/1992 | Chaix | |
| 5,484,018 | A | | 1/1996 | Cavender et al. | |
| 5,813,461 | A | | 9/1998 | Theisen | |
| 5,944,109 | A | * | 8/1999 | Longbottom | 166/313 |
| 6,079,494 | A | * | 6/2000 | Longbottom et al. | 166/313 |
| 6,227,298 | B1 | * | 5/2001 | Patel | 166/321 |
| 6,302,216 | B1 | * | 10/2001 | Patel | 166/375 |
| 6,494,265 | B2 | * | 12/2002 | Wilson et al. | 166/322.1 |
| 6,516,886 | B2 | * | 2/2003 | Patel | 166/313 |
| 2003/0226665 | A1 | * | 12/2003 | Jones et al. | 166/313 |

FOREIGN PATENT DOCUMENTS

| | | |
|---|---|---|
| GB | 851096 | 10/1960 |
| GB | 1008383 | 10/1965 |
| GB | 1105949 | 3/1968 |
| WO | WO 92/08875 | 5/1992 |
| WO | WO 99/31352 | 6/1999 |
| WO | WO 00/29715 | 5/2000 |

* cited by examiner

*Primary Examiner*—Hoang Dang
(74) *Attorney, Agent, or Firm*—Bracewell & Patterson, L.L.P.

(57) ABSTRACT

A first passageway (17) provides a first fluid flow path, in a well between a first zone (9) and a, common region (26). A second passageway (23), outside the first passageway (17), provides a second fluid flow path; between the second zone (10) and the common region (26). The first passageway (17) is provided with a first flow controller (25), for controlling the flow of fluid between the first zone (9) and the common region (26). The second passageway (23) is provided with a second flow controller (28), for controlling the flow of fluid between the second zone (10) and the common region (26).

12 Claims, 5 Drawing Sheets

FLUID FLOW CONTROL APPARATUS

The present invention relates to fluid flow control apparatus.

The control of the extraction or ingestion of fluid from or to a well in a fluid (e.g. oil or gas) extraction system is effected by chokes which have variable orifices in the production tube wall, typically operated by hydraulic or electric actuators. FIG. 1 shows a sectional view of a well with a choke fitted within a casing 1 of a borehole 2 and sealed with a packer 3. The choke body 4 of the choke is larger in diameter than production tubing 5 in order to accommodate a mechanical drive for controlling variable orifices 6 of the choke and its control and monitoring electronics around the circumference of the tubing 5. Thus, the standard sizes of the casings used in the fluid extraction industry determine the maximum diameters of choke bodies. In order to maximise the output extraction rate of the well, the maximum diameter of production tubing 5 is utilised. FIG. 1 also illustrates an extraction area 7 with a sand screen 8 fitted, as is typical. Invariably, the external diameter of the sand screen 8 is also limited by the bore of the casing 1, in order that it can be passed down it during installation.

Thus, as shown in FIG. 2, in the situation where there are two extraction zones 9 and 10, each with a respective one of sand screens 11 and 12, typically two chokes are fitted. Since the outer diameter of each of the choke bodies 13 and 14 does not allow it to pass through a sand screen, and/of the choke assembly is often too long to be accommodated by a sand screen, the two chokes are arranged in series as shown in FIG. 2, which shows the extracted fluid from zone 9 passing through the sand screen 11 to the variable orifices 15 of the lower choke having choke body 13 in a conventional manner, as shown by the arrows on the Figure. However, the extracted fluid from zone 10, through the sand screen 12, has to pass through the space between the choke body 13 of the lower choke and the well casing 1, in order to pass through variable orifices 16 of the upper choke having choke body 14. An alternative arrangement is to fit a choke of smaller diameter, and thus smaller production tubing bore, in the position of the upper choke. However, these typical arrangements create a number of problems:

1/ The flow of fluid between the choke body 14 and the casing 1 is seriously restricted by the relatively small gap between them.

2/ If the upper choke having choke body 14, is replaced with a choke of smaller dimensions, then a major redesign of the choke is required and the production flow tubing for the extraction from zone 10 is reduced.

It should be noted that when ingestion of fluid, typically water, into the well is required typically for maintenance, the same problems occur.

According to the present invention, there is provided apparatus for use in controlling the flow of fluid between first and second zones and a common region, comprising:

- a first passageway, for providing a first fluid flow path, between the first zone and the common region, in use of the apparatus; and
- a second passageway, outside the first passageway, for providing a second fluid flow path, between the second zone and the common region, in use of the apparatus, the first passageway being provided with first flow control means, for controlling the flow of fluid between the first zone and the common region and the second passageway being provided with second flow control means, for controlling the flow of fluid between the second zone and the common region.

The first and second passageways are preferably substantially concentric with each other.

The first and second control means may each comprise at least one orifice between the respective passageway and the common region.

The first and second passageways may be provided by first and second tubular members.

There may be sealing means between the first and second passageways for isolating the first and second flow paths from each other.

The apparatus may include a third passageway (for example provided by a tubular member) in fluid communications with the common region, which third passageway is preferably substantially co-axial with the first and second passageways.

There may be sealing means between the third passageway and the first and second passageways.

The third passageway may be in communication with the common region via at least one (preferably non-variable) orifice and in this case the or each such orifice may be in a wall of such tubular member providing the third passageway.

Each of the first and second passageways may be provided with means for varying the rate of fluid flow through the respective flow control means.

Apparatus according to the invention may be in the form of a choke assembly for use in controlling the flow of fluid between first and second zones and production tubing in a production well.

The present invention will now be described, by way of example, with reference to the accompanying drawings, in which.

Figure 1:
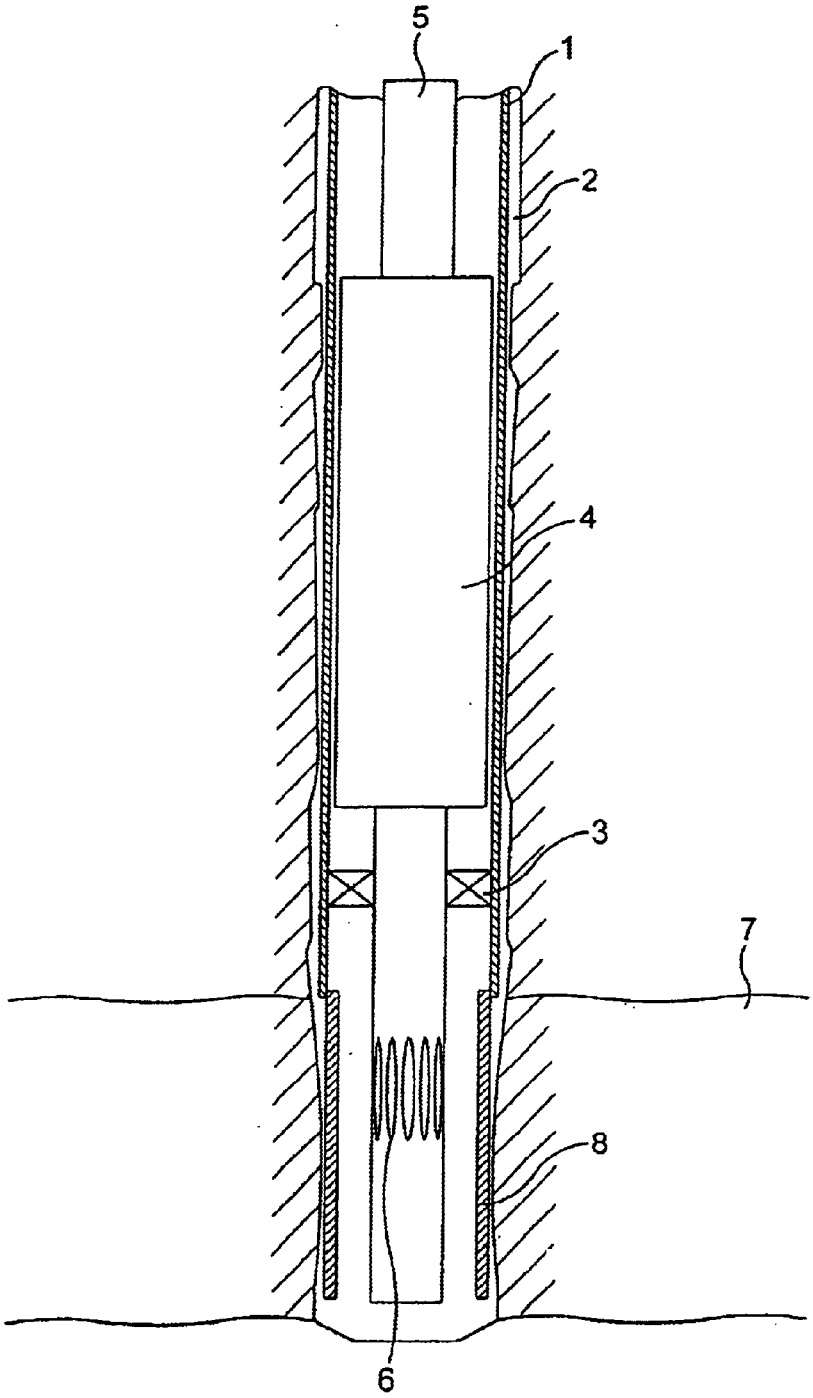
FIG. 1 (PRIOR ART)
FIGS. 1 and 2 are sectional views of known installations.
Figure 2:
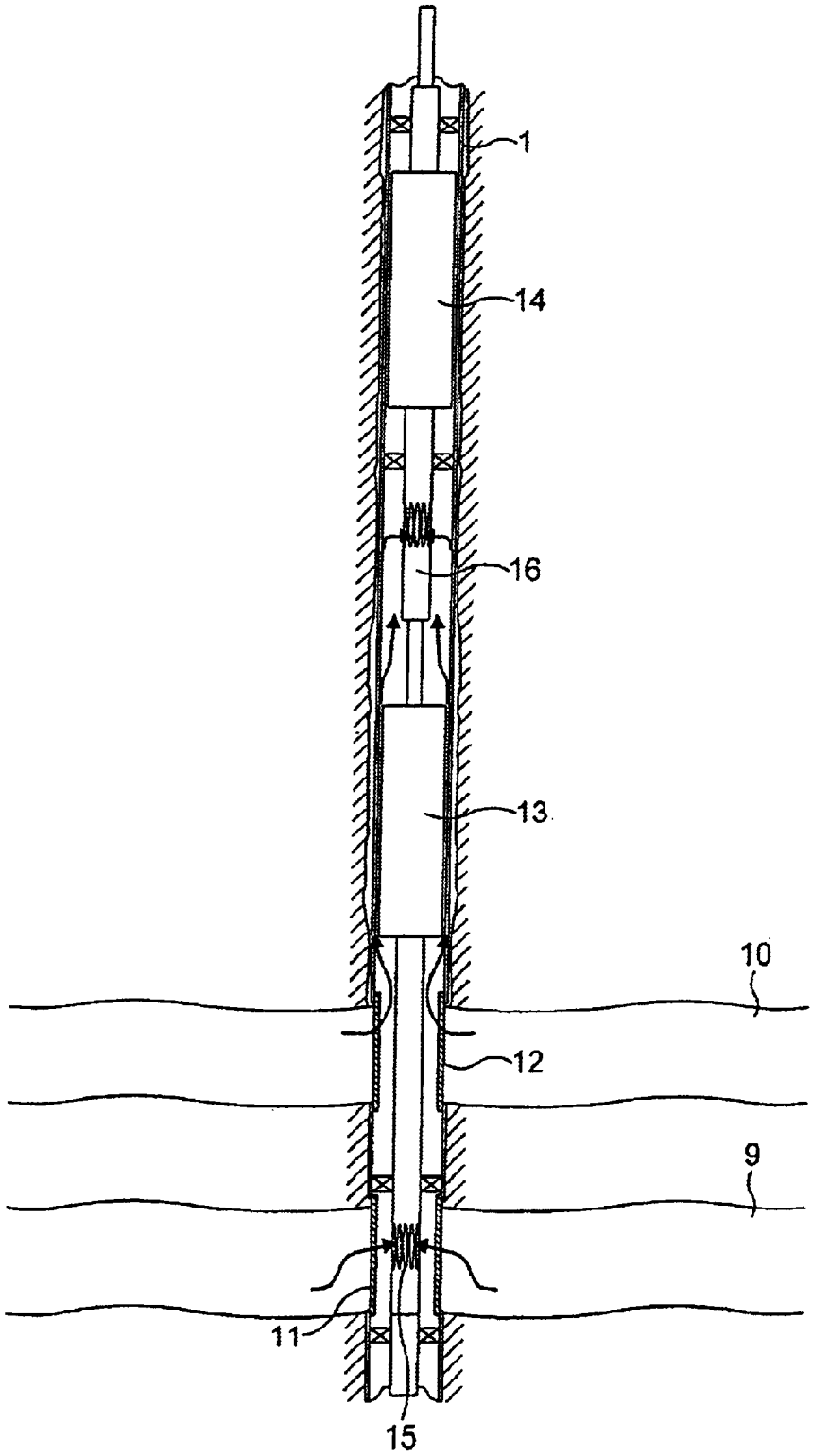
FIG. 2 (PRIOR ART)
Figure 3:
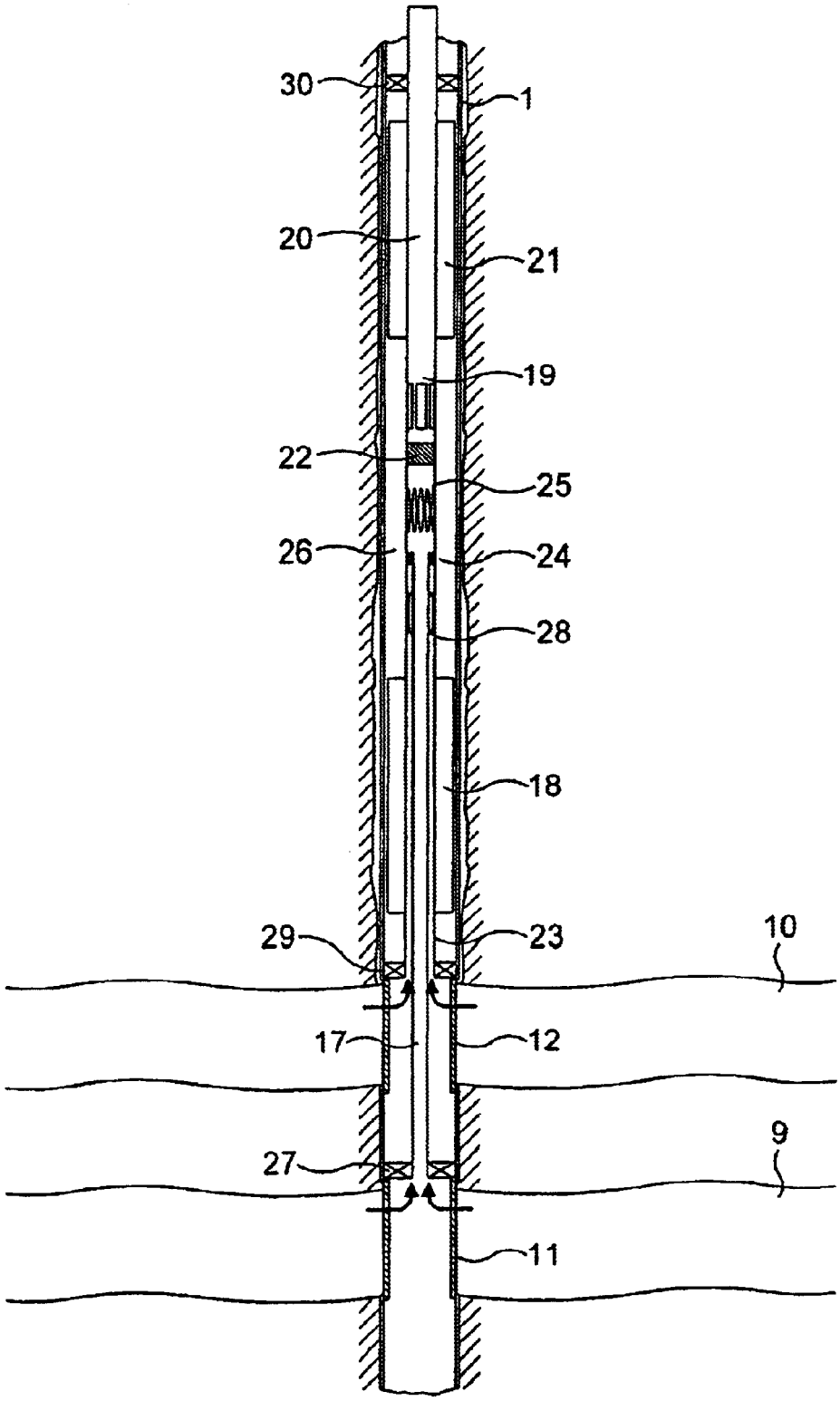
FIG. 3 is a schematic sectional view of apparatus according to an example of the invention.

FIG. 3 shows a sectional view of an installation using an example of the invention in a hydrocarbon production well. A tube 17, providing a first passageway, passes concentrically through a lower choke having a choke body 18 and fixed (non-variable) orifices 19 are in the wall of output production tubing 20 of an upper choke having a choke body 21. A removable plug 22 fitted as shown in FIG. 3 is in the tube 17 between the fixed orifices 19 and variable orifices 25 of the upper choke, this plug being of a removable type, typically expandable, in order to facilitate the use of a wire line tool for maintenance.

The concentric tube 17 passes through production tubing 23 (providing a second passageway) of the lower choke having choke body 18. The output from zone 9 passes via sand screen 11 through inner concentric tube 17 (as shown by the flow arrows), which is sealed from zone 10 by a seal 24 and out through the variable orifices 25 of the upper choke, into the space 26 between tubing 23 and tubing 20 and the well casing 1. The flow then enters the output production tubing 20 via the fixed orifices 19. Thus the orifices 25, which are varied (see FIG. 5) by the actuator of the upper choke, control the fluid flow from zone 9 into the production tubing 20.

The production zone 9 is isolated from the production zone 10 by a packer 27, and the output from zone 10 passes via sand screen 12 through production tubing 23 (as shown by the flow arrows) outside the tube 17, and out through variable orifices 28 of the lower choke, the orifices 28 being varied (see FIG. 5) by the actuator of the lower choke. The output from zone 10 then joins the fluid flow from zone 9, in the space 26 (providing a common region) between the tubing 23 and the tubing 20 and the well casing 1 and into the production tubing 20 via the fixed orifices 19.

Packers 29 and 30 prevent any leakage flow past the overall choke assembly.

Figure 4:
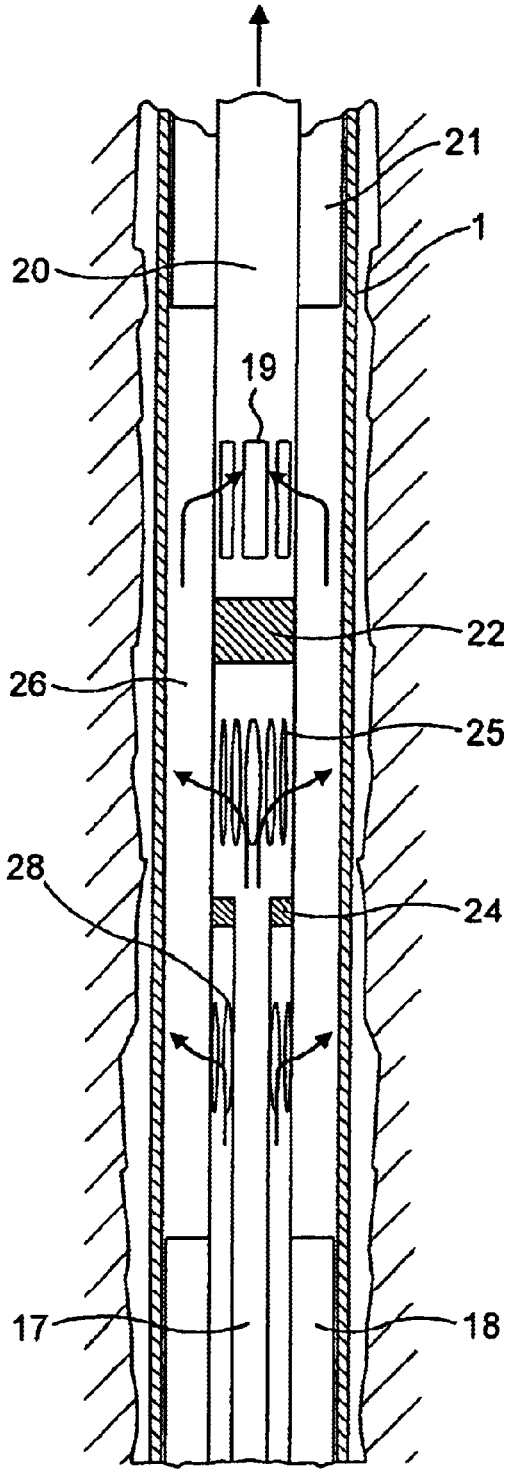
FIG. 4 is an enlarged view of part of what is shown in FIG. 3.

The fluid flow from the variable orifices and into the fixed orifices is shown diagrammatically in FIG. 4, which is an enlarged view of part of the overall choke assembly.

Figure 5:
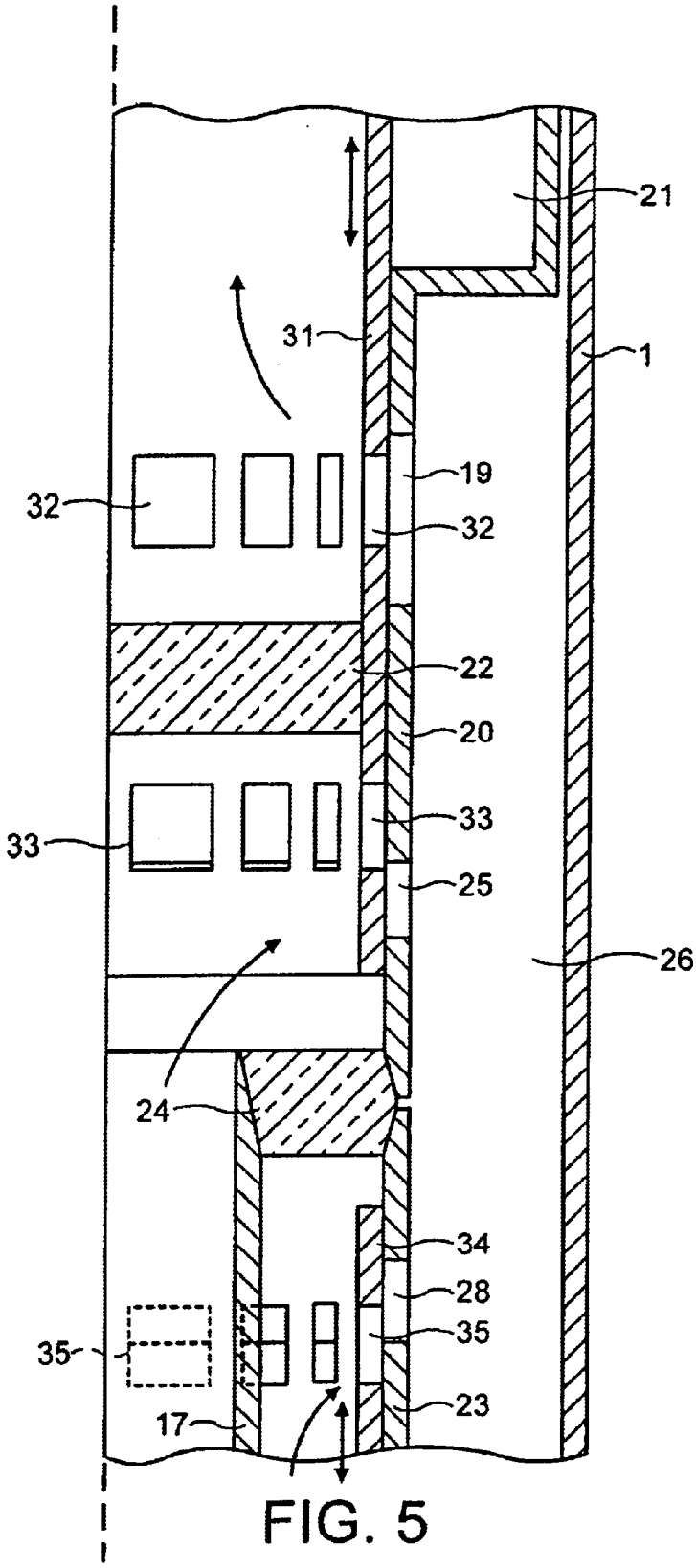
FIG. 5 is a part-sectional view showing how chokes of the apparatus are controlled.

FIG. 5 shows in more detail the realisation of what is shown in FIGS. 3 and 4. The seal 22 is in a tubular part 31 which is movable up and down in tubing 20 (which is fixed), tubular part 31 having, on the one hand, fixed orifices 32 receiving the flow from fixed orifices 19 and, on the other hand, having orifices 33 which vary the orifices 25, the tubular part 31 being moved by the actuator of the upper choke. In the lower choke there is a tubular body 34 moved up and down by the actuator of the lower choke and having orifices 35 which vary the orifices 28, tubing 23 being fixed.

It will be appreciated that the above example of the invention may also be used in reverse, that is for ingesting water, for example, into the zones 9 and 10.

What is claimed is:

1. Apparatus for use in controlling the flow of fluid between first and second zones and a common region, comprising:

a first passageway, for providing a first fluid flow path, between the first zone and the common region, in use of the apparatus;

a second passageway, outside the first passageway, for providing a second fluid flow path, between the second zone and the common region, in use of the apparatus, the first passageway being provided with first flow control means, for controlling the flow of fluid between the first zone and the common region and the second passageway being provided with second flow control means, for controlling the flow of fluid between the second zone and the common region; and a third passageway in fluid communication with the common region via at least one orifice.

2. Apparatus according to claim 1, wherein the first and second passageway are substantially concentric with each other.

3. Apparatus according to claim 1, wherein the first and second control means each comprises at least one orifice between the respective passageway and the common region.

4. Apparatus according to claim 1, wherein the first and second passageways are provided by first and second tubular members.

5. Apparatus according to claim 1, wherein there is sealing means between the first and second passageways for isolating the first and second flow paths from each other.

6. Apparatus according to claim 1, wherein the third passageway is substantially co-axial with the first and second passageways.

7. Apparatus according to claim 1, wherein there is sealing means between the third passageway and the first and second passageways.

8. Apparatus according to claim 1, wherein said at least one orifice via which the third passageway is in communication with the common region is non-variable.

9. Apparatus according to claim 1, wherein the third passageway is provided by a tubular member.

10. Apparatus according to claim 9, wherein said at least one orifice via which the third passageway is in communication with the common region is in a wall of the tubular member providing the third passageway.

11. Apparatus according to claim 1, wherein each of the first and second passageways is provided with means for varying the rate of fluid flow through the respective flow control means.

12. Apparatus according to claim 1, in the form of a choke assembly for use in controlling the flow of fluid between first and second zones and production tubing in a production well.

* * * * *